US008485657B2

(12) United States Patent
Pinto et al.

(10) Patent No.: US 8,485,657 B2
(45) Date of Patent: Jul. 16, 2013

(54) SUBLIMATION PRINTING PROCESSES AND FABRIC PRETREATMENT COMPOSITIONS FOR INK JET PRINTING ONTO ARBITRARY FABRICS

(75) Inventors: Gerard Robert Pinto, New York, NY (US); Christina Pinto, Yonkers, NY (US)

(73) Assignee: Advanced Chemical Solutions, LLC, Brooklyn, NY (US)

( * ) Notice: Subject to any disclaimer, the term of this patent is extended or adjusted under 35 U.S.C. 154(b) by 344 days.

(21) Appl. No.: 12/869,928

(22) Filed: Aug. 27, 2010

(65) Prior Publication Data

US 2011/0169901 A1 Jul. 14, 2011

Related U.S. Application Data

(60) Provisional application No. 61/293,267, filed on Jan. 8, 2010.

(51) Int. Cl.
*B41J 2/01* (2006.01)

(52) U.S. Cl.
USPC ..... 347/105; 347/96

(58) Field of Classification Search
USPC ..... 347/100, 95.96, 102, 103, 88, 99, 347/21, 20, 101, 105; 523/160, 161; 106/31.6, 106/31.13, 31.27; 428/195, 32.1
See application file for complete search history.

(56) References Cited

U.S. PATENT DOCUMENTS

| | | | | |
|---|---|---|---|---|
| 3,766,031 | A | 10/1973 | Dillon | |
| 3,918,895 | A | 11/1975 | Mizuno | |
| 4,029,870 | A | 6/1977 | Brown | |
| 4,052,278 | A | 10/1977 | Brown | |
| 4,119,398 | A | 10/1978 | Purser | |
| 4,210,412 | A | 7/1980 | Yamane | |
| 4,365,966 | A | 12/1982 | Bruno | |
| 4,492,584 | A | 1/1985 | Jenkins | |
| 4,576,610 | A * | 3/1986 | Donenfeld | 8/471 |
| 4,702,742 | A * | 10/1987 | Iwata et al. | 347/101 |
| 4,725,849 | A * | 2/1988 | Koike et al. | 347/106 |
| 4,969,951 | A * | 11/1990 | Koike et al. | 347/100 |
| 5,008,239 | A | 4/1991 | Donenfeld | |
| 5,015,261 | A | 5/1991 | Donenfeld | |
| 5,753,367 | A | 5/1998 | Takemura | |
| 6,451,914 | B1 | 9/2002 | Kloos | |
| 6,536,893 | B2 | 3/2003 | Kowalski | |
| 6,857,735 | B2 | 2/2005 | Furukawa | |
| 7,176,265 | B2 | 2/2007 | Morgan | |
| 7,579,409 | B2 | 8/2009 | Lavanga | |
| 2005/0057631 | A1 * | 3/2005 | Morimoto | 347/100 |
| 2007/0011819 | A1 * | 1/2007 | DeVries et al. | 8/115.51 |
| 2007/0256252 | A1 * | 11/2007 | Casella et al. | 8/137 |

OTHER PUBLICATIONS

Ebnesajjad, Sina, "Fluoroplastics, Non-Melt Processible Flurorplastics," PDL Handbook Series, 2000, vol. 1.
H. -J Hendriock, "PTFE Micropowders," Kunstoffe German Plastics, 1986, vol. 76, p. 920-926.
Gangal, S.V., "Tetrafluoroethylene Polymers," Encyclopedia of Polymer Science and Engineering, 1989, vol. 16, John Wiley & Sons.

* cited by examiner

*Primary Examiner* — Manish S Shah

(57) ABSTRACT

An ink jet printing process for sublimation printing of arbitrary textile fiber substrates, wherein the fiber materials are pretreated with an aqueous coating composition, enabling ink jet printing of natural and regenerated cellulosic fibers and blends thereof with synthetic fibers, by direct sublimation or sublimation transfer printing, applying to said fibers a novel textile coating or fabric pretreatment composition, wherein said textile coating or fabric pretreatment includes: an aqueous dispersion of fluoropolymer particles and a non-fluoropolymer binder.

18 Claims, No Drawings

SUBLIMATION PRINTING PROCESSES AND FABRIC PRETREATMENT COMPOSITIONS FOR INK JET PRINTING ONTO ARBITRARY FABRICS

CROSS-REFERENCE TO RELATED APPLICATION

This application claims the benefit of U.S. Provisional Application No. 61/293,267 filed on Jan. 8, 2010, and incorporates said Application herein in its entirety.

FIELD OF THE INVENTION

This invention relates to sublimation printing methods for textile printing using an ink jet process, in which an arbitrarily constructed textile fabric has been treated with an aqueous composition, enabling: 1) direct dye sublimation printing, as well as: 2) sublimation dye transfer printing of arbitrary textile fabrics, using inks composed of disperse dyes. More particularly, this invention relates to a method for direct sublimation printing or sublimation transfer printing of arbitrary fabrics, made from natural fibers, synthetic fibers, or blends therein, and particularly to the printing of cellulosic fabrics comprising natural and regenerated fibers, such as cotton and rayon, respectively. The present invention provides for fabric pretreatment compositions which enable sublimation printing of fabrics whereby the printed textile fabrics exhibit a soft texture and bright, vibrant colors, in which the printed fabrics also exhibit outstanding washfastness to repeated laundering.

The present invention relates to processes for printing textile fiber materials with disperse dyes by the ink jet printing process, wherein the fiber materials are 1) directly printed or 2) heat transfer printed with an ink jet ink comprising at least one disperse dye. Suitable disperse dyes for the process of the invention are those described under "Disperse Dyes" in the Colour Index, 3rd edition. Examples of such disperse dyes, capable of sublimation, include carboxyl- and/or sulfo-free nitro, amino, amino ketone, ketone imine, methine, polymethine, diphenylamine, quinoline, benzimidazole, xanthene, oxazine or coumarin dyes, anthraquinone dyes and azo dyes, such as monoazo or disazo dyes.

BACKGROUND OF THE INVENTION

The present invention relates to processes for printing arbitrary textile fiber materials, including all cellulosic fabrics and blends with synthetic fabrics, using inks composed of disperse dyes, in accordance with the ink jet printing process.

Conventional textile printing methods include rotary and flat-screen printing. Traditional analog printing typically involves the creation of a plate or a screen, that is, an actual physical image from which ink is transferred to the textile. However, unless the total printed yardage is sufficiently large, these conventional processes are neither economical nor practical. Conversely, because digital textile printing enables immediate printing of an electronic image, ink jet printers are now gaining rapid acceptance for sampling and small-quantity production and there is every expectation that digital textile printing will eventually supplant screen printing. Ink jet printing is a non-contact printing method in which picoliter ink droplets are deposited on some arbitrary ink-receptive substrate, according to the intended application.

Digital textile printing enables designers and manufacturers to immediately visualize a finished design. Furthermore, ink jet printing technology allows for superior textile design possibilities, in terms of the range of colors, the complexity of patterns, the ability to generate photorealistic images, and the prospect of creating non-repeating infinite patterns. The ability to quickly modify designs is quite simply enabled through textile design software, obviating a variety of costly and time-consuming steps, including screen engraving, machine set-up, and printing. Actual fabric samples of new designs are therefore generated both economically and expeditiously. Moreover, digital textile printing enables cost-effective short run production, thus accelerating the development of new products. And because printed fashion styles change quickly or are unpredictable, digital textile printing is clearly an ideal method of printing personal apparel and home furnishings, in which today's print patterns are subject to the whims of a changing market.

There are a number of problems in printing fabrics by the ink jet process that must still be addressed, however. Because the inks which are deposited onto fabric by the ink jet process are characterized by a very low viscosity, they are prone to spreading on the fabric; moreover, fabric texture may enhance or promote ink spreading. Invariably, some post-printing process, such as steaming or heat curing, which enables chemical and/or physical fixation of the dyes, is another critical aspect of textile printing, in general, and digital textile printing, in particular. Even after post-processing, dyes are often incompletely fixed within the fibers of the fabric, thus necessitating additional washing and drying steps in order to completely remove unfixed dyes from the fabric. Moreover, the printed textile images are often not detergent-resistant, resulting in fading of the printed image after washing by the consumer. Therefore, there remains a need to substantially enhance the permanence of printed textile images. It is especially desirable to eliminate the steaming post-printing process and to replace this time-consuming, inefficient process with a simple post-printing heating step, as per techniques and machinery that are common to both the analog and digital sublimation printing industries.

Because ink jet inks are prone to spreading on textile substrates, it is quite necessary to pretreat the fabric, in order to prevent the spreading of the ink. Among the inks that have been used for ink jet textile printing, sublimation inks incorporating disperse dyes have been used in one of two primary textile printing processes: 1) a direct sublimation or direct-to-textile printing method, wherein a dye-based or pigment-based disperse ink is directly printed onto a textile fabric, which is then followed by a heat treatment process, such as steaming or thermofixation, in order to permanently fix the dyes within the fibers of the fabric substrate; and 2) a sublimation heat transfer printing method, wherein, after a dye-based or pigment-based disperse ink is printed onto an intermediate sheet medium, e.g., specialized transfer paper, the sheet medium is then placed in intimate contact with a textile substrate, under a prescribed time, temperature, and pressure protocol, thus enabling the dye-based image to impregnate the textile substrate by sublimation heat transfer. The sublimation ink is in the form of a liquid obtained by emulsifying or dispersing the sublimation dye or the sublimation pigment into an aqueous or non-aqueous solution, including water, a water-soluble organic solvent, and a dispersant.

Sublimation printing is well-known in the art, having been practiced long before the emergence of digital textile printing and the use of sublimation inks in that context. Application of sublimation ink to a temporary transfer sheet may be accomplished by a number of well-known printing methods, such as rotogravure, offset lithography, or flexographic printing. The temporary support medium is then brought into intimate contact with the textile substrate, typically a 100% polyester or other synthetic fabric. The application of heat and pressure for a prescribed period of time induces sublimation of the disperse dyes from the transfer sheet, facilitating their transfer from the temporary support medium and into the fibers of the textile substrate, where they are physically impregnated and thus become a permanent part of the textile fabric.

However, it is equally well-known in the art that there has never been a single successful attempt to print cotton and other natural fiber fabrics by either direct sublimation or sublimation transfer of disperse dye inks. It may be shown, generally, that any fabric containing a cellulosic fiber, such as cotton or rayon, and printed either by direct sublimation or sublimation dye transfer will not be satisfactorily printed with the ink. For example, sublimation printing of any fabric consisting of cotton or a mixture of cotton and polyester fibers results in completely unsatisfactory printed images. Therefore, prior art methods have also included some type of fabric pretreatment or coating, or else a pretreatment of the sublimation dye transfer medium itself, with various chemicals and coating compositions, in order to enable cotton or other natural fibers to accept sublimable dyestuffs. However, all of these methods suffer from very poor performance, particularly with respect to the poor quality of the colors and/or the unacceptably low fastness of the dyes to repeated washing. Hence, while various pretreatments have been proposed over the past several decades, in order to enable cellulosic fibers or cellulosic fibers in blends with synthetic fibers, to be printed with sublimation inks, these pretreatments have invariably resulted in very poor color, unacceptable fastness, or acceptable color and/or fastness but a stiff and quite unacceptable fabric hand.

The present invention involves both direct disperse dye sublimation printing, as well as sublimation transfer, in which printing yields a dyed fabric having a very soft hand and bright, vibrant colors, and which is washfast to repeated laundering. The invention includes a novel fabric pretreatment composition and the methods for its application. The present invention is particularly innovative insofar as it allows for the first time, sublimation printing of fabrics made from natural fibers, including all cellulosics, such as cotton, in addition to fabrics composed of blends of natural and synthetic fibers. The method and compositions of this invention produce, for the first time, a sublimation fabric made of natural fiber or blends of natural and synthetic fibers, characterized by vibrant colors which will tolerate repeated laundering, without any color fading whatsoever.

It is an object of the present invention to provide pretreatment compositions for direct disperse sublimation printing or sublimation heat transfer printing of disperse dyes onto fabrics comprising substantial amounts of cotton or other natural fabrics. Accordingly, it is also an object of the present invention to provide textile printing methods which do not require steaming post-processing of arbitrarily constructed fabrics, including all cellulosic fabrics, as well as fabrics composed of blends of natural and synthetic fibers. Another object of the present invention is to provide a universal fabric pretreatment composition which makes it possible, for the very first time, textile printing of arbitrarily constructed fabrics, using only one type or class of ink, namely disperse dye ink, using any digital ink jet printing machine, capable of printing disperse dye inks, and furthermore, which is also applicable to all sublimation heat transfer processes which derive from analog (paper) printing processes. These processes include screen printing, gravure printing, and offset lithographic printing of the transfer paper substrate, using inks composed of disperse dyes.

SUMMARY OF THE INVENTION

The present invention details an ink jet printing process for sublimation printing of arbitrary textile fiber substrates, wherein the fiber materials are pretreated with an aqueous coating composition, enabling ink jet printing of natural and regenerated cellulosic fibers and blends thereof with synthetic fibers, by direct disperse dye sublimation printing or sublimation heat transfer printing, applying to said fibers a novel textile coating or fabric pretreatment composition, wherein said textile coating or fabric pretreatment comprises: an aqueous dispersion of fluoropolymer particles and a non-fluoropolymer binder.

The present invention provides for ink jet printed textile fabrics and sublimation printing methods of producing them which exhibit superior washfastness and excellent softness and feel. This invention represents a major breakthrough in terms of the properties of the sublimation printed textile fabrics, particularly for those fabrics containing natural fibers, such as cotton or blends of cotton and synthetic fibers, which are ink jet printed by direct sublimation or sublimation dye transfer processes, whereby the fabrics exhibit extremely vibrant colors, and whereby the fabrics also manifest an extremely soft texture, in which the printed fabrics also exhibit outstanding washfastness to repeated laundering. Indeed, this invention enables direct sublimation printing or sublimation dye transfer textile printing of all cellulosic fabrics and cellulosic blends therein, for the first time, using an ink jet printing process, but in addition, the invention is also applicable to all existing sublimation heat transfer processes which derive from analog (paper) printing processes. These processes include screen printing, gravure printing, and offset lithographic printing of the transfer paper substrate, using inks composed of disperse dyes.

The present invention provides for an ink jet textile printing method which does not require steaming post-processing of arbitrarily constructed fabrics, including all cellulosic fabrics, such as cotton and rayon, as well as fabrics composed of blends of natural and synthetic fibers. The present invention also provides for a universal pretreatment composition which makes it possible, for the very first time, textile printing of arbitrarily constructed fabrics, using only one type of ink, namely disperse dye ink, using any digital ink jet printing machine, which is capable of printing disperse dye inks either directly onto fabrics (direct disperse printing) or directly onto sublimation transfer paper (heat transfer printing), and furthermore, which is also applicable to all existing sublimation heat transfer processes which derive from analog printing processes, in which the transfer paper substrate is printed by screen printing, gravure printing, flexographic printing, or offset lithography, using specific inks composed of disperse dyes.

In some advantageous embodiments, the invention is provided by treating a desired fabric with an aqueous composition comprising: an aqueous dispersion of fluoropolymer particles and a non-fluoropolymer binder, said dispersion of fluoropolymer particles being composed of polytetrafluoroethylene (PTFE) micropowder, said PTFE micropowder being either a granular-based PTFE micropowder or a coagulated dispersion-based fine powder PTFE micropowder.

DETAILED DESCRIPTION OF THE INVENTION

The method for inkjet printing of the present invention includes a direct sublimation printing method, wherein an arbitrary textile fabric, for example, a textile fabric composed of a 50/50 blend of cotton and polyester fibers, is directly printed, with inks composed of disperse dyes, and wherein the fabric is then optionally subjected to a drying step, typically using a heating element within the digital textile printing machine itself, wherein the fabric is then subjected to a heat treatment process, in order to sublimate, and/or to promote dye diffusion, and to thereby fix the disperse dyes within the fibers of the fabric. The heat treatment process may include a high temperature or high pressure steaming process, in order to fix the dyes within or into the fibers of the fabric. High temperature or superheated steaming is generally conducted at 170 to 180 C for 10 minutes and high pressure steaming is generally conducted at 120 to 130 C for 20 minutes, in order to fix the dyes (wet heat fixation). Heat treatment (thermosol process) is generally conducted at 190 to 210 C for 60 to 120 seconds in order to fix the dyes (dry heat fixation). In a preferred embodiment of the invention, the printed textile fabric is advantageously heated directly in the digital textile printing machine itself, i.e., an ink jet textile printing machine that embodies an in-line heating system. In this manner, steaming post-processing is thereby completely eliminated for cellulosic fabrics and fabrics composed of blends of cellulosic fibers and synthetic fibers, allowing therefore, for the very first time, ink jet textile printing of cotton fabrics and cotton/polyester blends, using one textile printing machine, in which both the printing and heating systems are optionally completely integrated.

A sublimation transfer printing method of the present invention includes printing the disperse dye sublimation ink onto a temporary sheet medium, e.g. specialized transfer paper, by ink jet printing, placing the (paper) sheet medium in intimate contact with the textile fabric and heating the sheet medium, under a prescribed time, temperature, and pressure protocol, in order to sublimate and transfer the sublimation dye image from the sheet medium onto the textile fabric, thereby impregnating and permanently fixing the fibers with the disperse dyes of the sublimation ink printed on the sheet medium therein.

The printed textile fabric onto which the jetted ink has been applied is advantageously heated directly on the digital textile printing machine itself, i.e., a textile printing machine that embodies an in-line heating system. A number of heating systems may be used as the functioning element of any on-board or in-line heating apparatus that is built into the digital textile printing machine. Forced hot air may be used to apply heat in an oven, for example, in order to sublimate and thereby fix the disperse dyes within the fibers of the fabric. Additionally, other heating methods, such as infrared heating or other forms of radiant heating may also be used to induce thermofixation of the disperse dyes within the fabric. Additionally, heated platens may be used. Additionally, a pair of heated rollers, in the form of a hot roll laminator, which is capable of applying both heat and pressure, may be used to both heat and apply pressure to the printed textile fabric. Furthermore, conventional resistance or microwave-type heating units (ovens) may also be used. Thus, the claimed process shall not be restricted in any manner whatsoever to any particular self-contained heating device or heating system in connection with the heating apparatus that is built into or otherwise associated with the digital textile printing machine.

While the actual ink jet textile printing machine may include some type of heating apparatus contained therein, it will be generally understood that the term "therein" also refers to a sequential process of printing and subsequent thermofixation in which the heating subsystem is either placed inside the printing machine itself or is otherwise externally attached to the printing machine or is otherwise an altogether distinct, independent machine, separate and apart from the actual ink jet textile printing machine. This embodiment shall not be restricted to any type of integral or non-integral heating/pressing subsystem which generates heat and/or pressure to the textile fabric substrate, either immediately after the printing process or at some later time. Hence, the invention is understood to include thermofixation of the printed fabric by means of an external rotary or flat bed heat press, for example. Other heating schemes may alternatively be employed for subjecting the printed textile substrate to heat and/or pressure, including any independent means of generating heat by infrared or other forms of radiant heating, conventional forms of resistance heating, etc. and all such heating schemes are considered to be within the scope of the present invention.

In the ink-jet printing process related to the invention, fiber materials are pretreated with an aqueous coating composition, enabling ink jet printing of natural and regenerated cellulosic fibers, synthetic fibers, as well as blends thereof of natural and synthetic fibers, by direct disperse dye sublimation printing or sublimation heat transfer printing, by applying to said textile fibers a textile coating or fabric pretreatment composition, wherein application of the pretreatment to the textile fabric may be accomplished by any convenient method, such methods being generally well-known to those skilled in textile finishing operations. The application of the composition to the fibers may be affected, for example, by dipping, padding, spraying, coating, printing, impregnation, or by any other method of applying a liquid composition. The treatment may be applied to the textile fabric substrate in a single application, or in multiple applications. In general, the fabric pretreatment is applied to the textile substrate by padding or impregnation or coating, which is then followed by a drying process.

Padding is a preferred pretreatment application method. In padding, the fabric is dipped in the pretreatment solution, vis-a-vis a trough holding the pretreatment solution, whereby the saturated fabric is then passed through nip rollers that squeeze out the excess coating or pretreatment solution. The amount of solution retained in the fabric can be regulated by the nip pressure applied by the rollers. The wet pick-up of the pretreatment solution is preferably from 40 to 90% wet pick-up, more preferably from 50 to 85% wet pick-up. Typically, the coating is applied to the fabric substrate in a separate coating operation prior to printing, but the pretreatment operation may take place immediately prior to textile printing, using a modular coating machine, for example, which is specifically designed to be used in conjunction with a digital textile printing machine, the two units being disposed in-line with each other, in such a manner that the output of the modular coating machine is fed directly into the digital textile printing machine. Alternatively, the modular coating machine may also be used independently, directly analogous to that of a larger industrial padding and drying operation. The application of the composition to the fibers may be affected, for example, by dipping, padding, spraying, coating, printing, impregnation, or by any other method of applying a liquid composition.

Coating composition or pretreatment composition as used herein is generally meant to refer to a composition of the invention comprised of an aqueous coating agent as described herein. The coating or pretreatment composition may contain components in addition to the coating agents described herein. The use of the term "coating" in the phrase "coating composition" is not limited to the presence of the composition on any one surface of a textile substrate, but is intended to encompass a textile substrate that has been infiltrated with the composition, such that the pretreatment composition is substantively present within the fibers of the treated substrate. Unless specifically indicated otherwise, "coating" in reference to the coating compositions and coating agents of the invention is not meant to be limiting as to the manner of application of the compositions of the invention, or their final location on and/or within a treated textile substrate.

A wide variety of fabrics including both woven and non-woven fabrics may be sublimation printed according to the invention, including silk, cellulosics, cotton, wool, linen, cotton-polyester blends, polyester-rayon blends, rayon, nylon, acetates, and acrylates. Other fiber materials include polyacrylonitrile, polyamide, aramid, polypropylene, polyester, or polyurethane. The invention is of particular utility in direct sublimation printing and sublimation transfer printing of cotton fabrics and fabrics composed of blends of cotton with other fibers, especially synthetic fibers, such as polyester and nylon. The invention may be practiced using 100% polyester fabrics, if desired, in which the pretreatment composition serves to control the retention of the ink on the surface of the fabric. The invention is not limited to the above-mentioned fabric types, and those skilled in the art will be able to quickly determine applicability of the invention to other fiber types. The present invention ensures the quality of the printed image while preserving the flexible hand of the underlying textile substrate.

Any sublimable or non-sublimable disperse dye known to those skilled in the art, that might ordinarily be used to dye polyester may be used in practicing the invention. Preferred are disperse dyes, listed in the Colour Index under the heading "Disperse Dyes." The sublimation dye is preferably a disperse dye or solvent dye, capable of sublimation. These dyes can be used either individually or as a mixture. Disperse dyes are particularly preferred. Disperse dyes that sublimate at 70 C to 260 C under atmospheric pressure, such as azo, anthraquinone, quinophthalone, styryl, diphenylmethane or triphenylmethane, oxazine, triazine, xanthene, methine, azomethine, acridine, and diazine are suitable. Among these dyes, examples of a yellow disperse dye include C. I. Disperse Yellow 51, 54, 60, 64, 65, 82, 98, 119, 160, and 211. Examples of a red disperse dye include C. I. Disperse Red 4, 22, 55, 59, 60, 146, 152, 191, 302, and Vat Red 41. Examples of a blue disperse dye include C. I. Disperse Blue 14, 28, 56, 60, 72, 73, 77, 334, 359, and 366. Other color components are, e.g., Violet 27 and 28. Examples of the solvent dye include C. I. Solvent Orange 25, 60, Red 155, Blue 35, 36, 97, and 104.

The coating composition which comprises a combination of constituents includes: an aqueous dispersion of fluoropolymer particles and a non-fluoropolymer binder. Binder resins may include polyester, polyamide, polyamideimide, polyimide. polyether sulfone, polyphenylene sulfide, polyether ether ketone, silicone, epoxy, and acrylic resins, and blends of the foregoing. The binder resins may comprise approximately 1 to 7% by weight of the solid content of the coating, wherein approximately 20 to 100% by weight of the binder resin may include a resin with epoxy functional groups. In general, the coating composition consists of dissolving a binder resin in a solvent, the binder resin including an epoxy polymer; and blending the dissolved binder resin with an aqueous dispersion of fluoropolymer particles. Preferred binders are those that are soluble or solubilized in water or a mixture of water and organic solvent for the binder, which solvent is miscible with water. This solubility aids in the blending of the binder with the fluorocarbon component in the aqueous dispersion form. The dissolved binder is then blended with the fluoropolymer aqueous dispersion, in which the organic solvents facilitate a uniform coating composition. The blending can be achieved by simple mixing of the liquids together without using excess agitation so as to avoid coagulation of the fluoropolymer aqueous dispersion. Mixtures of organic binders with one or more aqueous dispersions of fluoropolymer particles, along with other particulate organic or inorganic fillers may be prepared from a base solution containing an aqueous solution of the binder resins, into which is added one or more aqueous dispersions of fluorinated particles.

The coating composition can be conveniently produced by blending together the various components making up the composition. Generally, the fluoropolymer particles will be in the form of an aqueous dispersion. These dispersions may be simply blended together and the non-fluorinated polymer may be added thereto. The non-fluorinated polymer may be in the form of an aqueous dispersion as well or may be dissolved or dispersed in an organic solvent such as for example an aromatic solvent such as toluene, xylene and the like. Other further ingredients may be added to the composition as aqueous dispersion or from a solution or dispersion in an organic solvent. Typically, an organic liquid is used in order to achieve an intimate mixture of fluoropolymer and polymer binder. The organic liquid may be chosen because a binder dissolves in that particular liquid. If the binder is not dissolved within the liquid, then the binder can be finely divided and be dispersed with the fluoropolymer in the liquid. The resultant coating composition can comprise fluoropolymer dispersed in organic liquid and polymer binder, either dispersed in the liquid or dissolved in order to achieve the intimate mixture desired. The characteristics of the organic liquid will depend upon the identity of the polymer binder and whether a solution or dispersion thereof is desired. Examples of such liquids include N-methylpyrrolidone, butyrolactone, high boiling aromatic solvents, alcohols, mixtures thereof, among others. The amount of the organic liquid will depend on the flow characteristics desired for the particular coating operation.

The aqueous coating composition, including an aqueous dispersion of fluoropolymer particles and a non-fluoropolymer binder, may be comprised of polytetrafluoroethylene (PTFE) micropowder, said micropowder being either a granular PTFE micropowder having a number average molecular weight of from $10^5$-$10^6$, or a fine powder PTFE micropowder having a number average molecular weight of from $10^4$-$10^5$. As used herein, the term "micropowder" refers to very finely divided low molecular weight polytetrafluoroethylene powder. These powders are either granular-based (suspension polymerized) or fine powder-based (emulsion or dispersion polymerized). Their molecular weight is in the range of a few ten thousand to a few hundred thousand compared to several million for the molding and extrusion (granular and fine powder) resins.

High molecular weight PTFE powder is available in two distinct forms, so-called "granular" PTFE and so-called "fine powder" PTFE. Granular PTFE powder is produced by suspension polymerization in the absence of surfactant and generally is a spongy, porous irregular particle having a very high molecular weight of about 10 million. Fine powder PTFE is coagulated from an aqueous dispersion of primary or discrete sub-micron PTFE particles, which are produced by the emulsion polymerization method, in which the presence of a fluorinated surfactant acts to stabilize the dispersion of growing polymer particles, each individual particle composed of PTFE molecules having a molecular weight of from about 1 million to about 5 million. Hence, fine powder PTFE is also known as coagulation-based or CD-based PTFE powder.

Both the term "granular" and "fine powder" PTFE include herein homopolymer tetrafluoroethylene and modified PTFE, so-called because the homopolymer is modified by copolymerization with a copolymerizable ethylenically unsaturated comonomer in a very small amount, typically less than 1% by weight of the copolymer. These PTFE copolymers are called "modified" because the basic chemical and/or physical characteristics of homopolymer PTFE remain essentially unchanged, in which the copolymer remains non-melt-processable, just as the high molecular weight homopolymer is non-melt-processable. Examples of comonomers include olefins such as ethylene and propylene; halogenated olefins, such as hexafluoropropylene (HFP), vinylidene fluoride (VdF), and chlorotrifluoroethylene (CTFE); or perfluoroalkyl vinyl ethers, such as perfluoropropyl vinyl ether (PPVE).

"PTFE micropowder," also known as "PTFE wax," can be prepared either by radiation or thermal degradation of non-melt-flowable high molecular weight PTFE powders, i.e., "granular molding powders" or "coagulated dispersion-based fine powders", or directly by polymerization of tetrafluoroethylene and other comonomers in the presence of a chain transfer agent. PTFE micropowder manufacturing processes generally make use of electron beam sources for irradiating PTFE, wherein PTFE is exposed to radiation and thereafter subjected to comminution or grinding to provide a fine particle powder. Sources of radiation include an electron beam, gamma rays, nuclear radiation, or radiation from a cobalt-60 source. The irradiation of a dry powder PTFE material in ambient air enables $O_2$ in the air to interact with the dry PTFE and to form thereby end groups, for example, carboxyl fluoride (—COF) groups, at the ends of the PTFE polymer chains. Such end groups then react with water to form carboxylic acid (—COOH) end groups. Their preparation is described, for example, in U.S. Pat. No. 3,766,031, U.S. Pat. No. 3,838,030, U.S. Pat. No. 4,029,870, U.S. Pat. No. 4,036,718 and U.S. Pat. No. 4,052,278. Alternatively, the micropowder may be post-treated with ammonia, in order to generate neutral carboxylamide (—$CONH_2$) end groups.

PTFE micropowders are generally white, free-flowing micropowders and have a molecular weight below that of PTFE granular molding resins or CD-based, fine powder (paste) extrusion resins, e.g., less than a molecular weight of about 900,000 and desirably less than about 800,000. The melt flow rate (g/10 min) is from 0.1 to 40. The micropowder generally has an average particle size of from about 1 to about 20, desirably from about 1 to about 12, and preferably from about 3 to about 8 microns. PTFE micropowder has a much lower molecular weight than the normal high melt viscosity PTFE, e.g. PTFE granular powder or PTFE CD-based fine powder, enabling the micropowder to be melt-flowable, in which the melt viscosity of the micropowder is less than $10^5$ (Pa)(s) at 372 C. Preferably the melt viscosity of the PTFE micropowder is less than $10^4$ (Pa)(s) at 372 C. Although the PTFE micropowder is melt-flowable, that is, the powder will deform under heat and pressure, the extruded or molded product has virtually no mechanical strength due to the low molecular weight of the PTFE macromolecules comprising the PTFE micropowder, and therefore, PTFE micropowders are not melt-processable by themselves.

Commercially available granular-based PTFE micropowders which can be utilized according to the embodiments of the invention include: Zonyl MP1000, MP1200, MP1300, and MP1400, manufactured by Dupont; Polymist F5A, manufactured by Solvay Solexis; Fluon PTFE L169J, manufactured by AGC Japan; Dyneon PTFE J14 and J24, manufactured by Dyneon; Ultraflon MP-10 and MP-80/92, manufactured by Laurel Products; and SST-4, by Shamrock. Commercially available CD-based PTFE micropowders which can be utilized according to the embodiments of the invention include: Zonyl MP1100, manufactured by DuPont; Algoflon L201 manufactured by Solvay Solexis; Fluon PTFE L170J, L172J, and L173J, manufactured by AGC Japan; Dyneon TF 9207 PTFE, manufactured by Dyneon; Ultraflon MP-25 and MP-55, made by Laurel Products. CD-based or coagulated dispersion-based PTFE micropowders are composed of primary PTFE particles, typically around 0.25 microns, and therefore, under high shear mixing, the micropowder may be disagglomerated, thereby greatly increasing the intrinsic surface area.

The aqueous coating composition, including an aqueous dispersion of fluoropolymer particles and a non-fluoropolymer binder may be comprised of an aqueous dispersion of sub-micron fluoropolymer particles. The sub-micron fluoropolymer particles are stabilized by the use of surfactant, generally a fluorinated surfactant, in the aqueous (fluorinated latex) dispersion, obtained directly by emulsion polymerization, during the actual manufacturing process, which may be followed by concentration of the latex dispersion, and/or further addition of surfactant or surfactant mixtures or surfactant/polymer mixtures, thereby generating the final commercial form of the aqueous dispersion of (surfactant-stabilized and/or polymer-stabilized) sub-micron fluoropolymer latex particles. Examples of commercial aqueous latex dispersions include: GP1, manufactured by AGC Chemicals; TE3859, manufactured by DuPont; and 5032R, by Dyneon.

The fluoropolymer component composing the dispersed fluoropolymer particles of the coating composition is preferably non-melt processable polytetrafluoroethylene (PTFE) having a melt viscosity of at least $10^8$ (Pa)(s) at 380 C. However, such PTFE latex can also contain a small amount of comonomer modifier, such as perfluoroolefin, notably hexafluoropropylene (HFP) or perfluoro(alkyl vinyl) ether, notably wherein the alkyl group contains 1 to 5 carbon atoms, with perfluoro(propyl vinyl ether) (PPVE) being preferred. The amount of such modifier will be insufficient to confer melt-fabricability to the PTFE, generally being no more than 0.5 mole %. A mixture of PTFEs having different melt viscosities can be used to form the fluoropolymer component.

While PTFE or modified PTFE is preferred, the fluoropolymer component composing the dispersed fluoropolymer particles of the coating composition can also be a melt-processable fluoropolymer, in which the non-melt-processable PTFE latex and the melt-processable PTFE latex may be blended or otherwise combined into one aqueous dispersion of fluoropolymer particles. Examples of such melt-processable fluoropolymers include copolymers of TFE and at least one fluorinated copolymerizable monomer (comonomer) present in the polymer in a sufficiently high amount, so as to reduce the melting point of the copolymer substantially below that of TFE homopolymer, polytetrafluoroethylene (PTFE), e.g., to a melting temperature no greater than 315 C. Preferred comonomers with TFE include the perfluorinated monomers such as perfluoroolefins having 3-6 carbon atoms and perfluoro(alkyl vinyl ethers) (PAVE) wherein the alkyl group contains 1-5 carbon atoms, especially 1-3 carbon atoms. Especially preferred comonomers include hexafluoropropylene (HFP), perfluoro(ethyl vinyl ether) (PEVE), perfluoro(propyl vinyl ether) (PPVE) and perfluoro (methyl vinyl ether) (PMVE). The term perfluorinated monomer includes monomers consisting of carbon and fluorine atoms but also includes monomers in which some of the fluorine atoms are replaced by chlorine or bromine atoms, such as, for example, in chlorotrifluoroethylene (CTFE).

Specific examples of perfluorinated vinyl ethers include perfluoroalkyl vinyl ethers such as perfluoro n-propyl vinyl ether (PPVE-1), perfluoro-2-propoxypropylvinyl ether (PPVE-2), perfluoro-3-methoxy-n-propylvinyl ether and perfluoro-2-methoxy-ethylvinyl ether. Further examples of perfluorinated comonomers include perfluorinated allyl ethers. Copolymers that are all commercially available include: copolymers of tetrafluoroethylene and hexafluoropropylene (FEP copolymers), copolymers of tetrafluoroethylene and perfluoroalkyl vinyl ether (PFA copolymers), and copolymers of ethylene and tetrafluoroethylene (ETFE), as well as MFA copolymers (TFE/PMVE/PAVE wherein the alkyl group of PAVE has at least two carbon atoms). Non-limiting examples of other acceptable fluoropolymers are polychlorotrifluoroethylene (PCTFE), ethylene-chlorotrifluoroethylene copolymer (ECTFE), ethylene-tetrafluoroethylene copolymer (ETFE), polyvinylfluoride (PVF), and polyvinylidene fluoride (PVDF), as well as a fluoropolymer terpolymer composed of three repeating monomer units, specifically, tetrafluoroethylene ("TFE"), hexafluoropropylene ("HFP"), and vinylidene fluoride ("VDF") units. Fluoropolymer copolymers including TFE, HFP, and VDF monomers are collectively referred to as "THV". One suitable THV terpolymer is Dyneon 2030G Z. Further examples of such fluoropolymers are HFP/VDF copolymers, ethylene fluorinated ethylene-propylene ("EFEP") terpolymers, and other possible combinations of ethylene and fluoroethylenic monomers. There are a myriad of commercially available fluoropolymers and the specific fluoropolymer chosen does not limit the scope of the present invention. Aqueous FEP dispersions include: TE-9568, manufactured by DuPont, and Neoflon ND-110, manufactured by Daikin; PFA aqueous dispersions include: TE-7224, manufactured by DuPont.

The aqueous coating composition, including an aqueous dispersion of fluoropolymer particles and a non-fluoropolymer binder may be comprised of an aqueous dispersion comprising particles of granular-type PTFE molding resin, as well as an aqueous dispersion comprising particles of CD-based fine powder PTFE paste extrusion resin. The aqueous coating composition may be prepared by premixing granular PTFE micropowder, CD-based fine powder PTFE micropowder, as well as fine powder granular PTFE molding resin and CD-based fine powder PTFE paste extrusion resin. Mixing may be carried out by adding the components of the PTFE micropowder and PTFE fine powder compositions to a container, followed by shaking, agitating, or stirring the dry powders within the container. The PTFE micropowder composition, as well as the PTFE fine powder composition, may also be generated as a dispersion in an aqueous, inorganic, or organic liquid medium, in order to facilitate blending with other components of the aqueous coating composition. In a preferred embodiment of the invention, the granular PTFE micropowder, the CD-based fine powder PTFE micropowder, and a fine powder PTFE molding resin are each present in a mixture. Compositions containing mainly the granular PTFE micropowder, mainly the CD-based fine powder PTFE micropowder, or mainly the fine powder granular PTFE molding resin are all within the scope of the invention. The aqueous coating composition, including an aqueous dispersion of fluoropolymer particles may include PTFE micropowder, along with PTFE melt-processable copolymer particles, as well as PTFE non-melt-processable copolymer particles. High molecular weight PTFE fine powder granular molding resin includes FLUON G163. High molecular weight PTFE fine powder paste extrusion resin includes FLUON CD123. A aqueous suspension of granular-type PTFE powder and/or fine powder-type PTFE powder is easily generated by blending together a thickening agent, a block copolymer surfactant, and a fluorinated surfactant and then adding the PTFE powder to the composition.

Micropowders suitable for use in accordance with the present invention include, but are not limited to, organic materials, inorganic materials, pulverized minerals, and combinations thereof. The organic materials include, but are not limited to, organic polymers, such as, for example, the group of polymers known as tetrafluoroethylene (TFE) polymers. The TFE polymer group includes, but is not limited to PTFE homopolymers and PTFE copolymers, wherein the homopolymers and copolymers each individually contain small concentrations of at least one copolymerizable modifying monomer, such that the PTFE resins remain non-melt-processable (modified PTFE). The modifying monomer can be, for example, hexafluoropropylene (HFP), perfluoro(propyl vinyl) ether (PPVE), or chlorotrifluoroethylene (CTFE). The concentration of such copolymerized modifiers in the polymer is usually less than 1 mole percent. The PTFE and modified PTFE resins that can be used in this invention include those derived from suspension polymerization, as well as, those derived from emulsion polymerization. The pulverized minerals can be, for example, clays, talc, calcium carbonates or mica. The inorganic materials can be, for example, precipitated and fumed silica, aluminum silicate, calcium sulfate, ferric or ferrous sulfate, titanium dioxide, aluminum oxide, and zinc oxide. The coating compositions may contain a variety of other additives, such as fillers, stabilizers, plasticizers, lubricants, organic solvents, colloidal silica, mica, coloring agents, levelling agents, and tackifiers.

The organic materials include, but are in no way limited to, organic polymers which can be made into a powder, more particularly, any resin powder to which a sublimation dye can physically adsorb and thereby remain permanently attached. Examples include polyvinyl acetate copolymers, polyvinyl alcohol, polyvinyl formal, polyvinyl butyral, acrylic polymers, epoxy polymers, urethane polymers, ethylene/vinyl acetate copolymers, ethylene/vinyl alcohol copolymers, ethylene/ethyl acrylate copolymers, ethylene/acrylic acid copolymers, vinyl chloride/vinyl acetate copolymers, vinyl chloride/vinyl acetate/maleic anhydride terpolymers, polyvinyl ether polymers, polyester polymers, and cellulosic polymers. These may be used singly or as mixtures, with or without fluoropolymer powders. The resin powders preferably have an average particle diameter of about 0.5 microns to about 100 microns, generally about 1 to about 20 microns and may be produced by any pulverization or grinding method, a solution spraying or precipitation method, or directly by emulsion, dispersion, or suspension polymerization methods.

Other organic materials useful in the present invention are low molecular weight synthetic resins, hydrocarbon waxes, natural waxes, higher fatty acid amides, as well as higher alcohol and polyhydric alcohol higher fatty acid esters. The low molecular weight synthetic resins include polyamide and polyvinyl chloride. The hydrocarbon waxes include paraffin wax and polyethylene wax, and synthetic waxes, such as microcrystalline wax. The natural waxes include vegetable waxes, such as carnauba wax. The higher fatty acid amides include ethylene bis-stearic acid amide, stearic acid amide, oleic acid amide, methylol stearic acid amide and 12-hydroxystearic acid amide. The higher alcohol fatty acid esters include ethoxylcetyl alcohol and ethoxylstearyl alcohol. The polyhydric alcohol higher fatty acid esters include glycerin oleate, glycerine stearate, propylene glycol stearate, ethylene glycol stearate, and 12-hydroxystearate.

The aqueous coating composition, including an aqueous dispersion of fluoropolymer particles and a non-fluoropolymer binder may be comprised of: (A) a high molecular weight epoxy resin, preferably a bisphenol A-epichlorohydrin resin, although equivalent epoxy resins are also suitable. The solids content of this resin constitutes about 1% to about 7% of the total weight of the composition, and has a molecular weight in the range of from about 50,000 to about 200,000. (B) A portion of the epoxy resin may be a low molecular weight resin having a molecular weight in the range of from about 300 to about 500; however, no more than about 15% by weight of the solids content of the epoxy may be in the low molecular weight range. (C) A suitable cross-linking agent for the epoxy resin present in the range of from about 2% by weight to about 25% by weight of the solids content of the epoxy resin. Various well-known cross-linking agents may be used, such as a melamine-formaldehyde resin or an etherified resol-phenolic resin, including urea formaldehyde, as well as phenol-formaldehyde (resol-type), and these may be present in the range of from 2% to 25% by weight of the solids content of the epoxy resin. Various solvents, such as tolune, xylene, isophorone, and butyl cellosolve, for example, may be used in a relatively wide range of concentration and one solvent may be substituted for another solvent. Various epoxy resins may be used to provide the specified molecular weights in the range of from about 300 to about 200,000. For instance, Hexion Specialty Chemicals provides an epoxy resin identified as EPONOL 53-BH-35 which has an average molecular weight of 80,000. Hexion Specialty Chemicals also provides an EPONOL 55-BH-30 epoxy resin with an approximate molecular weight of 200,000. Hexion Specialty Chemicals also provides an EPON Resin 828, which has an average molecular weight of approximately 380. Accordingly, these resins span the aforementioned molecular weight range of from about 300 to about 200,000.

The aqueous coating composition, including an aqueous dispersion of fluoropolymer particles and a non-fluoropolymer binder may be comprised of polytetrafluoroethylene (PTFE) micropowder or PTFE latex, said PTFE micropowder or PTFE latex being treated by a high energy source, such as electron beam radiation, to immobilize organic molecules, including macromolecules, on the surface of the fluoropolymer particles by a process known as radiation-grafting. Methods of treating fluoropolymer particles are well-known and they include using a high energy source, such as atmospheric plasma, x-ray radiation, electron radiation, ion beam irradiation, ultraviolet radiation, or any other method to change or otherwise modify the functional characteristics of the fluoropolymer particles. Herein "radiation" and "irradiation" each generally refer to treatment by exposure to ionizing radiation. Moreover, the fluoropolymer particles may be dispersed in a liquid medium and subjected to high energy treatment while in the liquid medium, such high energy treatment including atmospheric plasma, x-ray radiation, electron radiation, ultraviolet radiation, etc. Specifically, the fluoropolymer particles, while they are dispersed in a liquid medium, may be admixed therein with organic molecules, including macromolecules, and thereafter subjected to high energy treatment, such as ionizing radiation and, in particular, electron beam irradiation, in order to surface treat the fluoropolymer powders by immobilizing the organic molecules or macromolecules thereon. In addition, for PTFE, the irradiation treatment simultaneously induces chain scission within the fluoropolymer, thereby reducing the molecular weight of the fluoropolymer to form a surface-treated fluoropolymer dispersion. This surface-treated fluoropolymer dispersion may optionally be dried to form a surface-treated fluoropolymer micropowder.

Polytetrafluoroethylene polymers not only provide superior heat resistance, chemical resistance, and corrosion resistance, the extremely low frictional coefficient and surface free energy of PTFE enable aqueous dispersions of fluoropolymer particles to be especially useful in fabric pretreatment applications, in which finished textiles exhibit very good stain-resistance and much better wear-resistance. Hence, a plethora of woven and non-woven materials, ranging from industrial textiles to apparel fabrics and upholstery fabrics, may derive additional benefits from the PTFE powder which is impregnated within the fibers during the textile fabric pretreatment operation.

Obviously, numerous modifications and variations of the present invention are possible in view of the above claims. It is understood, therefore, that the invention may be practiced much more generally or otherwise than as specifically described herein.

EXAMPLES

This invention is further illustrated by the following examples, which are for illustrative purposes only, and are not intended to limit the invention, as described above. Modifications may be made without departing from the scope of the invention.

Example 1

A coating composition was prepared by dissolving an epoxy binder resin in a solvent mixture, said solvent mixture composed of 2-propoxyethanol, 2-butoxyethanol, and isopropyl alcohol. The high molecular weight epoxy polymer was a bisphenol A-epichlorohydrin resin, EPONOL 53-BH-35, and it is available from Hexion Specialty Chemicals. Subsequently, the dissolved binder was then blended with an aqueous dispersion of a granular-based PTFE micropowder, Ultraflon MP-80/92, which is manufactured by Laurel Products, in which the organic solvent mixture facilitates a uniform coating composition. Blending is achieved by low shear mixing of the liquids together without using excess agitation, in order to avoid coagulation of the fluoropolymer aqueous dispersion. The final percent solids, by weight, of the aqueous coating composition, was 18%, in which the weight ratio of PTFE micropowder to epoxy was 5:1, with the solvent making up 25% of the total solids. The fabric pretreatment was then applied to various textile substrates by padding, in which the fabric is dipped in the pretreatment solution, vis-a-vis a trough holding the pretreatment solution, whereby the saturated fabric was then passed through nip rollers that squeezed out the excess coating or pretreatment solution. The amount of solution retained in the fabric was regulated by the nip pressure applied by the rollers. The wet pick-up of the pretreatment solution was dependent on the particular fabric, with 75% wet pick-up being typical, while the dry pick-up was ~10%. The fabric was oven dried at 250 C.

The treated fabrics included: cotton duck; cotton sateen; cotton sheeting; rayon; silk charmeuse; nylon flag, 50/50 cotton/polyester; 100% cotton T-shirt knit, and polyester duck. Each of these textile fabrics was then printed by the ink jet printing process, where each substrate was either: 1) directly printed (direct disperse dye sublimation) or 2) sublimation heat transfer printed with ink jet inks, composed of disperse dyes. The directly printed fabrics were then processed on a flat bed heat press, at a temperature of 180 C-200 C, for 20 seconds, using two sheets of tissue paper to protect the printed fabric. Each fabric was then subjected to a cold water wash step.

In the sublimation transfer printing method, the disperse dye sublimation ink was first printed onto specialized transfer paper, by ink jet printing, then the transfer sheet was placed in intimate contact with the textile fabric and processed, either on a flat bed heat press, or on a rotary heat press, the temperature ranging from 170 C-190 C, depending on the actual fabric; the dwell time was typically 20 seconds. Each fabric was then subjected to a cold or warm water wash step.

All of the sublimation printed textile fabrics exhibited extremely vibrant colors and an extremely soft texture, in which the printed fabrics also exhibited outstanding washfastness and excellent stain-resistance. Moreover, the printed textiles manifested outstanding wear resistance, as demonstrated by a dry crockfastness rating of 4.5/5.0, according to AATCC test method 8, for the cotton duck sample, printed by direct sublimation.

Comparative Example 2

A coating composition was prepared, essentially according to Example 1, except that a crosslinking agent and a catalyst were added to the mixture, thus enabling the epoxy component to effectively crosslink, during the sublimation step. While the fabric hand was noticably stiffer, compared to the sample prints generated on the basis of the formulation in Example 1, the actual print density, along with the associated washfastness, was not affected, demonstrating, therefore, that the underlying mechanism governing the invention is the physical adsorption and retention of the disperse dyes onto the surface of the PTFE micropowder particles, in which the extremely high adsorption free energy derives from the strong hydrophobic interaction between the disperse dyes and the fluoropolymer particles, distributed within the fibers of the pretreated textile fabric.

What is claimed is:

1. An ink jet printing process for sublimation printing of arbitrary textile fiber substrates, wherein the fiber materials are pretreated with an aqueous coating composition, enabling ink jet printing of natural and regenerated cellulosic fibers and blends thereof with synthetic fibers, by direct sublimation or sublimation transfer printing, applying to said fibers a textile coating or fabric pretreatment composition, wherein said textile coating or fabric pretreatment comprises: an aqueous dispersion of fluoropolymer particles and a non-fluoropolymer binder, wherein said aqueous fluoropolymer dispersion comprises particles of PTFE micropowder, said micropowder being either a granular-based PTFE micropowder or a coagulated dispersion-based fine powder PTFE micropowder, in which the term "micropowder," as used herein, refers to very finely divided low molecular weight polytetrafluoroethylene (PTFE) powder, in which the fluoropolymer component composing the dispersed fluoropolymer particles is non-melt-processable PTFE or non-melt-processable modified PTFE, so-called because the PTFE homopolymer is modified by copolymerization with a copolymerizable ethylenically unsaturated comonomer in a very small amount, typically less than 1% by weight of the copolymer. These powders are either granular-based (suspension polymerized) or (fine powder) coagulated dispersion-based (emulsion or dispersion polymerized) powders. Their molecular weight ranges from a few ten thousand to a few hundred thousand compared to several million for the high molecular weight as-polymerized PTFE granular molding resins and CD-based fine powder extrusion resins.

2. An ink jet printing process for sublimation printing of arbitrary textile fiber substrates, according to claim 1, wherein the method for inkjet printing includes a direct sublimation printing method, wherein an arbitrary textile fabric, for example, a textile fabric composed of a 50/50 blend of cotton and polyester fibers, is directly printed, using disperse dye inks, and wherein the fabric is then optionally subjected to a drying step, typically using a heating element within the digital textile printing machine itself, wherein the fabric is then subjected to an arbitrary heat treatment process, enabling sublimation and diffusion of the disperse dye into the fibers of the textile fabric substrate, thereby fixing the disperse dyes within the fibers of the fabric, thus forming a permanent, washfast printed image embedded within the textile fabric substrate.

3. An ink jet printing process for sublimation printing of arbitrary textile fiber substrates, according to claim 1, wherein the heat treatment process, according to claim 2, includes a high temperature (superheated) or high pressure steaming process, in order to fix the dyes into the fibers of the fabric.

4. An ink jet printing process for sublimation printing of arbitrary textile fiber substrates, according to claim 1, wherein the heat treatment process, according to claim 2, includes a steamless or essentially dry heating process, in order to fix the dyes into the fibers of the fabric.

5. An ink jet printing process for sublimation printing of arbitrary textile fiber substrates, according to claim 1, wherein the printed textile fabric onto which the jetted ink has been applied is heated directly in the digital textile printing machine itself, i.e., a digital textile printing machine that embodies a self-contained, in-line heating system.

6. An ink jet printing process for sublimation printing of arbitrary textile fiber substrates, according to claim 1, wherein the heat treatment process, according to claim 2, includes: the use of forced hot air, in order to apply heat in an oven, the use of infrared heating or other forms of radiant heating, the use of heated platens, the use of a pair of heated rollers, i.e., a hot roll laminator, and the use of conventional electrical resistance or microwave heating ovens. The heat treatment process shall not be restricted in any manner to any particular self-contained heating device or heating system that may be used in connection with the heating apparatus that is built into or otherwise associated with the digital textile printing machine.

7. An ink jet printing process for sublimation printing of arbitrary textile fiber substrates, according to claim 1, wherein the printed textile fabrics do not require steaming post-processing, said textile fabrics including all cellulosic fabrics, such as cotton and rayon, as well as fabrics composed of blends of natural and synthetic fibers.

8. An ink jet printing process for sublimation printing of arbitrary textile fiber substrates, according to claim 1, wherein a universally applicable pretreatment composition is applied to arbitrarily constructed textile fabrics, in which said textile fabrics may consist of any class of fiber materials, such as silk, wool, nylon, cotton, rayon, polyester, cotton/polyester blends, rayon/polyester blends, as well as all other types of textile fabrics composed of arbitrary blends of natural and synthetic fibers, including blends of nylon and lycra, cotton and lycra, or polyester and lycra, or any other combination of blended fiber textile fabrics that are common to both the analog and digital textile printing industries.

9. An ink jet printing process for sublimation printing of arbitrary textile fiber substrates, according to claim 1, wherein the method for ink jet printing includes a sublimation transfer printing method: printing the disperse dye sublimation ink onto a temporary sheet medium, e.g. a specialized transfer paper, by ink jet printing, placing the (paper) sheet medium in intimate contact with the textile fabric and heating the (paper) sheet medium, under a prescribed time, temperature, and pressure protocol, in order to sublimate and transfer the sublimation dye image from the sheet medium onto and within the textile fabric, thereby impregnating and permanently fixing the fibers composing the textile fabric with the disperse dyes embodied in the printed image on the sheet medium therein.

10. An ink jet printing process for sublimation printing of arbitrary textile fiber substrates, according to claim 1, wherein sublimation fixation of the printed textile fabric is accomplished by means of an external rotary or flatbed heat press or any other form of heat treatment, including other heating methods, such as infrared heating or other forms of radiant heating that may be used to induce sublimation fixation of the disperse dyes in the textile fabric. The heat treatment process shall not be restricted in any manner to any particular self-contained heating device used in connection with the sublimation transfer printing method of claim 9.

11. An ink jet printing process for sublimation printing of arbitrary textile fiber substrates, according to claim 1, wherein a wide variety of fabrics, including both woven and nonwoven fabrics, may be sublimation printed according to the invention, including silk, cellulosics, cotton, wool, linen, cotton-polyester blends, polyester-rayon blends, rayon, nylon, acetates, and acrylates. Other fiber materials include polyacrylonitrile, polyamide, aramid, polypropylene, polyester, or polyurethane.

12. An ink jet printing process for sublimation printing of arbitrary textile fiber substrates, according to claim 1, wherein the method includes a direct sublimation printing method, in which the pretreatment composition is applied to 100% polyester fabrics, in which the pretreatment composition serves to control the retention of the ink on the surface of the ink jet-printed polyester fabric.

13. An ink jet printing process for sublimation printing of arbitrary textile fiber substrates, according to claim 1, wherein the printed textile fabrics exhibit superior washfastness and excellent softness and feel, whereby the fabrics also exhibit bright, vibrant colors, in which the printed fabrics also exhibit outstanding washfastness to repeated laundering, and in which the printed fabrics also exhibit stain-resistance, UV light fade resistance, as well as wear-resistance.

14. An ink jet printing process for sublimation printing of arbitrary textile fiber substrates, according to claim 1, wherein the pretreatment composition is applied to the textile fibers by inkjet printing, padding, spraying, coating, (screen) printing, or impregnation.

15. An ink jet printing process for sublimation printing of arbitrary textile fiber substrates, according to claim 1, wherein the ink jet sublimation ink is composed of any sublimable dye, preferably disperse dyes or solvent dyes, capable of sublimation. These dyes can be used in the sublimation ink either individually or as a mixture. Disperse dyes, which are particularly preferred include well-known dyes which may be classified according to their chemical structure, including dyes of the following chemical classes: azo, anthraquinone, quinophthalone, styryl, diphenylmethane or triphenylmethane, oxazine, triazine, xanthene, methine, azomethine, acridine, and diazine.

16. An ink jet printing process for sublimation printing of arbitrary textile fiber substrates, according to claim 1, wherein the coating or fabric pretreatment composition comprises: an aqueous dispersion of submicron fluoropolymer latex particles, said submicron fluoropolymer latex particles being stabilized in-situ by a surfactant, generally a fluorinated surfactant, as directly obtained by emulsion polymerization of fluorinated monomers and comonomers by the dispersion manufacturer during the actual latex manufacturing process.

17. An ink jet printing process for sublimation printing of arbitrary textile fiber substrates, according to claim 1, wherein the coating or fabric pretreatment composition comprises: an aqueous dispersion of fluoropolymer particles and a non-fluoropolymer binder, in which the fluoropolymer component composing the dispersed fluoropolymer particles is a melt-processable PTFE copolymer, such that copolymerization with a copolymerizable ethylenically unsaturated comonomer reduces the melting point of the copolymer substantially below that of the TFE homopolymer, polytetrafluoroethylene (PTFE), e.g., to a melting temperature less than 315 C.

18. An ink jet printing process for sublimation printing of arbitrary textile fiber substrates, according to claim 1, wherein the coating or fabric pretreatment composition comprises: an aqueous dispersion of fluoropolymer particles and a non-fluoropolymer binder, in which said aqueous fluoropolymer dispersion comprises particles of granular PTFE molding resin, and/or said aqueous fluoropolymer dispersion comprises particles of CD-based fine powder PTFE paste extrusion resin.

* * * * *